US006352640B1

(12) United States Patent
Cook et al.

(10) Patent No.: US 6,352,640 B1
(45) Date of Patent: Mar. 5, 2002

(54) CAUSTIC EXTRACTION OF MERCAPTANS (LAW966)

(75) Inventors: Bruce Randall Cook, Stewartsville; Richard Harry Ernst, Glen Gardner, both of NJ (US); Mark Alan Greaney, Upper Black Eddy, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/551,006

(22) Filed: Apr. 18, 2000

(51) Int. Cl.[7] ..... C10G 29/20

(52) U.S. Cl. ..... 208/237; 208/206; 208/207; 208/288

(58) Field of Search ..... 208/235, 206, 208/207

(56) References Cited

U.S. PATENT DOCUMENTS

| | | | | | |
|---|---|---|---|---|---|
| 1,796,621 | A | | 3/1931 | Ramage | |
| 1,968,842 | A | | 8/1934 | Malisoff | 196/24 |
| 1,973,499 | A | | 9/1934 | Morrell | 196/24 |
| 2,059,075 | A | | 10/1936 | Yabroff et al. | 196/32 |
| 2,152,166 | A | | 3/1939 | Yabroff | 196/32 |
| 2,152,721 | A | | 4/1939 | Yabroff | 196/32 |
| 2,152,723 | A | | 4/1939 | Yabroff | 196/32 |
| 2,152,730 | A | | 4/1939 | Yabroff | 196/32 |
| 2,160,632 | A | | 5/1939 | Yabroff et al. | 196/32 |
| 2,168,078 | A | | 8/1939 | Yabroff | 196/32 |
| 2,183,801 | A | | 12/1939 | Yabroff | 196/32 |
| 2,186,398 | A | | 1/1940 | Yabroff | 196/32 |
| 2,212,105 | A | | 8/1940 | Yabroff | 196/32 |
| 2,212,106 | A | | 8/1940 | Yabroff | 196/32 |
| 2,212,107 | A | | 8/1940 | Yabroff | 196/32 |
| 2,297,866 | A | | 10/1942 | Benedict | 196/32 |
| 2,309,651 | A | | 2/1943 | McCullough et al. | 196/32 |
| 2,425,777 | A | | 8/1947 | Adams et al. | 196/30 |
| 2,437,348 | A | | 3/1948 | Brown et al. | 196/32 |
| 2,570,277 | A | | 10/1951 | Ricards, Jr. et al. | 196/32 |
| 2,593,851 | A | | 4/1952 | Cool et al. | 196/32 |
| 2,608,519 | A | | 8/1952 | Deters et al. | 196/24 |
| 2,634,230 | A | | 4/1953 | Arnold et al. | 196/24 |
| 2,776,929 | A | | 1/1957 | Vanderbilt | 196/32 |
| 2,792,332 | A | | 5/1957 | Hutchings | 196/14.17 |
| 3,956,112 | A | * | 5/1976 | Lee et al. | 210/21 |
| 4,124,493 | A | | 11/1978 | Frame | 208/206 |
| 4,156,641 | A | | 5/1979 | Frame | 208/207 |
| 4,206,079 | A | | 6/1980 | Frame | 252/428 |
| 4,290,913 | A | | 9/1981 | Frame | 252/428 |
| 4,337,147 | A | | 6/1982 | Frame | 208/206 |
| 4,362,614 | A | * | 12/1982 | Asigian | 208/235 |
| 4,562,300 | A | * | 12/1985 | La Foy | 208/230 |
| 4,626,341 | A | | 12/1986 | Verachtert | 208/235 |
| 4,753,722 | A | | 6/1988 | Le et al. | 208/207 |
| 4,824,818 | A | | 4/1989 | Bricker et al. | 502/163 |
| 5,167,797 | A | | 12/1992 | Ou | 208/236 |
| 5,273,646 | A | | 12/1993 | Frame et al. | 208/189 |
| 5,290,427 | A | | 3/1994 | Fletcher et al. | 208/89 |
| 5,582,714 | A | | 12/1996 | Forte | 208/237 |
| 5,840,177 | A | | 11/1998 | Weers et al. | 208/208 R |
| 5,985,136 | A | | 11/1999 | Brignac et al. | 208/216 R |
| 6,013,175 | A | | 1/2000 | Weers et al. | 208/208 R |
| 6,013,598 | A | | 1/2000 | Lapinski et al. | 502/305 |

OTHER PUBLICATIONS

Mason, C.F., Bent, McCullough, Atlantic Refining Co., Philadelphia, PA.; "Naphtha Treating Pays Its Way", The Oil and Gas Journal, Nov. 6, 1941, pp. 114, 116, 119.

O'Donnell, John P.; "Tannin Solutizer Process Practically Automatic; Saves 6.5 Cents Per Barrel", The Oil and Gas Journal, Engineering and Operating Section, Jul. 1, 1944, pp. 45–47.

Border, L.E., Shell Oil Co., Inc., "Shell Operating First Solutizer Treating Plant at Wood River", The Oil and Gas Journal, Engineering and Operating Sections; Nov. 7, 1940, pp. 55–56.

Lowry Jr., C. D. and Moriarty, F. C.; "Unisol Process Improves Octane Number and Tel Susceptibility"; The Oil and gas Journal, Nov. 3, 1945, pp. 105, 107, 109.

Field, H. W., Atlantic Refining Co., Philadelphia, PA.; "Caustic–Methanol Mercaptan Extraction Process Used"; The Oil and Gas Journal, Sep. 25, 1941, pp. 40–41.

Satchell, Donald P., Jr.; "Effect of Olefins on Hydrodesulfurization of a Cracked Naphtha Reformer Feed", Michigan State University, East Lansing, Michigan, 1969.

Holbrook, D. L., UOP, Des Plaines, Illinois; "UOP Merox Process", Chapter 11.30 (Handbook of Petroleum Refining Processes, Robert A. Meyers, Editor in Chief, Second Edition); published by McGraw–Hill.

California Oil World, Petroleum Publishers, Inc., C. Monroe, President and Editor; Second Issue, Apr. 1944, vol. 34, No. 8, Whole No. 1655, p. 1, Apr. 27, 1944.

Moriarty, F. C., Universal Oil Products Co., Chicago; "Unisol Treatment Effects Large Savings for Big West Oil Company"; California Oil World, Petroleum Publishers, Inc., Second Issue, Apr., 144. pp. 19–20.

Border, L. E., Shell Oil Co., Inc., Wood River, Illnois; "Solutizer—A New Principle Applied to Gasoline Sweetening", Chemical & Metallurgical Engineering, Nov. 1940, pp. 776–778.

Moriarty, F. C., Universal Oil Products Co., Chicago; "Effective Method of Reducing Mercaptans Cuts Refining Costs"; Petroleum World, pp. 53–55.

Yabroff, D. L. and White, E. R., Shell Development Company, Emeryville, California;"Action of Solutizers in Mercaptan Extraction"; Industrial and Engineering Chemistry, Jul. 1940, pp. 950–953.

Band, C. H, and Cluer, A.; "Application of the Unisol Process in Great Britain"; Petroleum, Sep. 1958, pp. 305–308.

(List continued on next page.)

*Primary Examiner*—Helane Myers
(74) *Attorney, Agent, or Firm*—Estelle C. Bakun; Gerard J. Hughes

(57) ABSTRACT

The invention describes a method for preparing a low sulfur motor gasoline utilizing ethanol and caustic extraction.

8 Claims, 1 Drawing Sheet

OTHER PUBLICATIONS

Lyles, H. R., Cities Service Refining Corporation, Lake Charles, Louisiana; "New Unisol Stripper Improves Operations", Petroleum Refiner, Mar., 1955, pp. 207–209.

Mason, C. F., Bent, R.D., and McCullough, J. H., The Atlantic Refining Co, Philadelphia, PA.; "Naphtha Treating 'Pays Its Way'", Division of Refining, vol. 22[III], 1941, pp. 45–51.

Moriarty, F. C.; "Unisol Process for Treating Gasoline" (Mercaptans Removed by Extraction with Concentrated Solution of Caustic Soda Containing Methanol; The Ptroleum Enigneer, Apr. 144, pp 150–152.

Bent, R. D. and McCullough J. H.; "Unisol Process", The Oil and Gas Journal, Sep. 9, 1948, pp. 95, 97, 100, 103.

* cited by examiner

CAUSTIC EXTRACTION OF MERCAPTANS (LAW966)

FIELD OF THE INVENTION

The invention describes a process for decreasing the amount of mercaptans in petroleum streams, particularly naphtha streams.

BACKGROUND OF THE INVENTION

Future environmental regulations will require significantly lower sulfur levels in motor gasoline. The proposed regulations will require the complete desulfurization of cat naphtha, which contains the vast majority of the sulfur in gasoline. There is a large economic incentive to remove or reduce the sulfur in cat naphtha while retaining olefins which are important for octane. Selective cat naphtha hydroprocessing requires the selective conversion of organosulfur to hydrogen sulfide (HDS) while minimizing olefin saturation (SAT).

In the late '30's, '40's and early '50's, before the advent of large scale fluid cat cracking (FCC), a range of improved technologies for extracting C6 to C9 mercaptan sulfur from thermal cracked naphtha were developed. These technologies were required because mercaptan and disulfide sulfur had a strong negative interaction with tetraethyl lead, which was then used in considerable quantities to improve gasoline octane. These technologies relied on solutizing additives, such as methanol, ethanol, or isopropanol to significantly improve the extractability of gasoline range mercaptans. With the advent of FCC technology, the solutizing technologies were no longer required since FCC does not produce mercaptans in this product range.

Several references teach the removal of mercaptans and phenolic compounds from petroleum distillates. For example, U.S. Pat. No. 2,309,651 teaches the use of a countercurrent extraction utilizing an alkaline reagent and solvent such as methanol. Although the reference teaches other alcohols, such as ethanol, propanol, isopropanol etc., methanol is preferred.

U.S. No. 2,347,348 teaches the removal of mercaptans from gasoline utilizing a caustic methanol solution. Though the reference speaks of other suitable organic solvents such as ethanol, propanol, acetone, ethylene glycol etc. methanol is the preferred solvent.

What is needed in the art is a method for economically and effectively removing mercaptans from petroleum streams.

SUMMARY OF THE INVENTION

The invention includes a method for decreasing the amount of mercaptans in a petroleum stream comprising the steps of:

(a) extracting said petroleum stream containing mercaptans with an extractant comprising ethanol and an aqueous base to produce a product having a decreased concentration of mercaptans and a used extractant comprising said extracted mercaptans, ethanol and base;

(b) recovering said product having a decreased amount of mercaptans.

Surprisingly, applicants have discovered that when ethanol is utilized in conjunction with a base to extract mercaptans from a hydrodesulfurized petroleum stream, or a petroleum stream containing mercaptans, it is much more effective than other alcohols, including methanol, which is taught as the preferred alcohol in the solutizing art. Furthermore, since ethanol is a beneficial component of mogas, the instant extraction method is economical and practical.

DETAILED DESCRIPTION OF THE INVENTION

Figure 1:
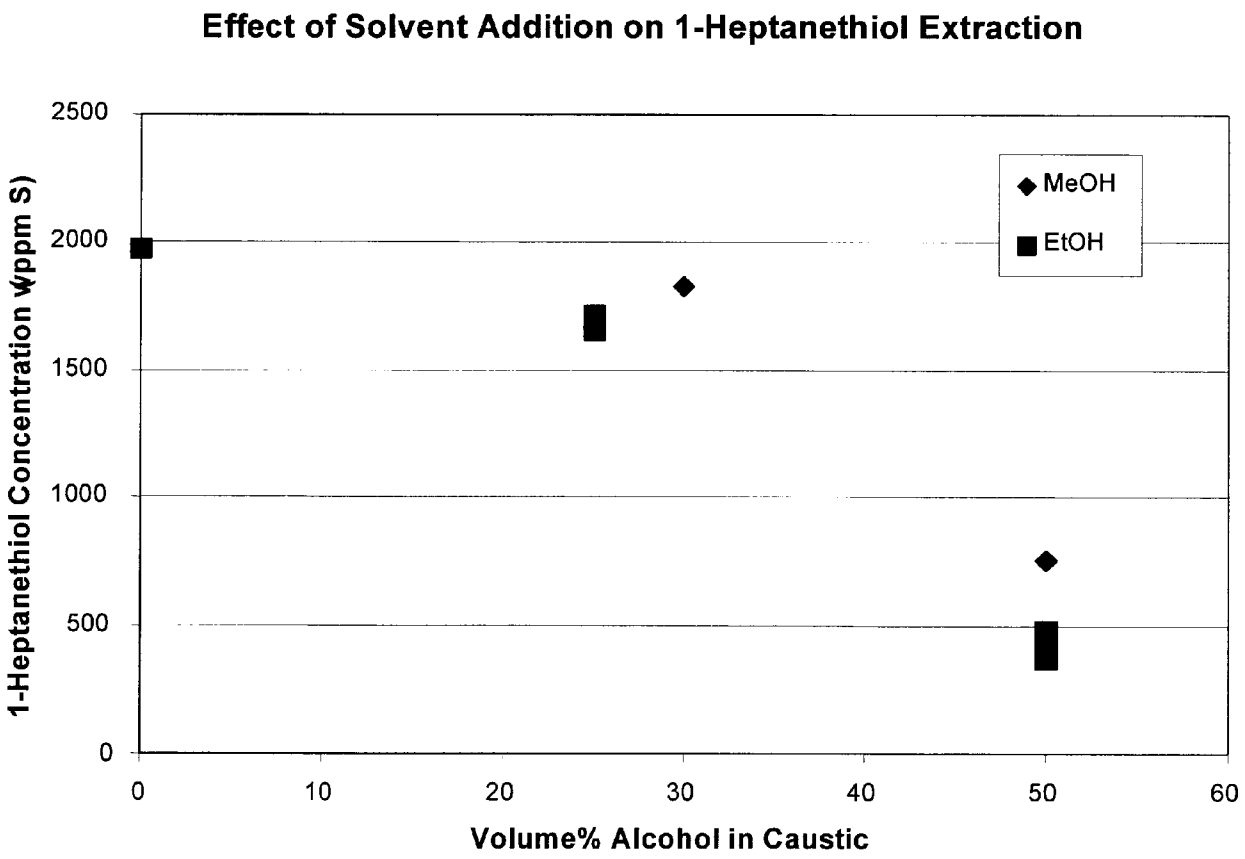
FIG. 1 depicts the effect of alcohol content on 1-heptanethiol extraction.

The invention includes the use of ethanol as a solutizing agent in conjunction with base to extract mercaptans from petroleum streams including streams which have been hydrodesulfurized by any known technique. Surprisingly, ethanol is a much more effective solutizing agent than the preferred alcohol, methanol, taught by the art.

Hydrodesulfurization processes are well known in the art. During such processes, an addition reaction occurs whereby the hydrogen sulfide produced during the process reacts with feed olefins to form alkylmercaptans. This reaction is commonly referred to as mercaptan reversion. The extraction step taught herein allows for the removal of the mercaptans produced, hence, allowing for a lower sulfur product. The ethanol amount utilized is greater than 10 vol %, more preferably greater than 25 vol %, and most preferably greater than 45 vol % of the combination of ethanol and aqueous base.

The extraction process may utilize any basic reagent which is capable of extracting mercaptans from the feed stream. A preferred basic reagent comprises an aqueous solution of ammonia or an alkaline metal hydroxide, such as sodium or potassium hydroxide. Aqueous base may be used in concentrations of from 1 to 50 wt % with a preferred concentration range being from about 5 to 50 wt % of the combination of aqueous base and ethanol. The amount of the combination of aqueous base and ethanol to be used to treat the product of the HDS unit for mercaptans removal or a mercaptan containing petroleum stream can range from at least about 25 volume % upward. Preferably about 10 to 75 volume %, more preferably to about 25 to about 65 volume %, and most preferably about 40 to 60 volume % will be used. Typically, the aqueous base and ethanol extractant will be at least 1N, preferably, at least 6N. The maximum normality permissible is readily determined by the skilled artisan based on the extraction being conducted.

Thus, in one aspect of the instant invention a hydroprocessing step may be combined with a mercaptans extraction step conducted using a base (caustic) in combination with ethanol.

Any HDS process known in the art can be utilized. For example, both thermal and catalytic HDS can precede the extraction. Such processes are well known to the skilled artisan.

The conditions for the extraction step utilized herein can be easily selected by the skilled artisan. Preferably, the conditions utilized will be those described in U.S. Pat. No. 4,626,341 herein incorporated by reference.

For example, the conditions employed in the extraction zone may vary greatly depending on such factors as the nature of the hydrocarbon stream being treated and its mercaptan content, etc. The skilled artisan can readily select such conditions with reference to the solutizing art. However, in general, the mercaptan extraction may be performed at an ambient temperature above about 60 degrees Fahrenheit 15 degrees Celsius) and at a pressure sufficient to ensure liquid state operation. With very light material in the feed stream, this may be impractical and the extraction is performed with a vapor phase feed stream. The pressure may range from atmospheric up to 6895 kPag (1000 psig) or more, but a pressure in the range of from about 1000 to 2400 kPag (145 to about 348 psig) is preferred.

The temperature in the mercaptan extraction zone is confined within the range of 10 to 121 degrees Celsius (50 to 250 degrees Fahrenheit), preferably from 27 to 49 degrees Celsius (80 to 120 degrees Fahrenheit). The rate of flow of the ethanol and aqueous base extractant will typically be about 1 to 3% of the rate of flow of an the petroleum stream being treated and may be up to about 20% of the stream. The extraction zone is preferably a vertically trayed column having a large number of circular perforations. Optimum extraction in this liquid system is obtained with a velocity through the perforations of from about 5 to about 10 feet per second. A packed column and other types of extraction equipment could be employed if desired.

Once the petroleum stream having organo sulfur and mercaptans removed therefrom is separated from the used extractant mixture, the used extractant mixture can then be recycled to extract a fresh petroleum containing mercaptan or hydroprocessed petroleum stream or regenerated to remove mercaptans and the base and ethanol then recycled. The preferred streams treated in accordance herewith are naphtha streams, more preferably, treated in accordance herewith are naphtha streams, more preferably, intermediate naphtha streams. Regeneration of the spent base can occur using either steam stripping as described in The Oil and Gas Journal, Sep. 9, 1948, pp95–103 or oxidation followed by extraction into a hydrocarbon stream.

Typically regeneration of the mercaptan containing used extractant is accomplished by mixing the stream with an air stream supplied at a rate which supplies at least the stoichiometric amount of oxygen necessary to oxidize the mercaptans in the caustic stream. The air or other oxidizing agent is well admixed with the base and the mixed-phase admixture is then passed into the oxidation zone. The oxidation of the mercaptans is promoted through the presence of a catalytically effective amount of an oxidation catalyst capable of functioning at the conditions found in the oxidizing zone. Several suitable materials are known in the art.

Preferred as a catalyst is a metal phthalocyanine such as cobalt phthalocyanine or vanadium phthalocyanine, etc. Higher catalytic activity may be obtained through the use of a polar derivative of the metal phthalocyanine, especially the monosulfo, disulfo, trisulfo, and tetrasulfo derivatives.

The preferred oxidation catalysts may be utilized in a form which is soluble or suspended in the alkaline solution or it may be placed on a solid carrier material. If the catalyst is present in the solution, it is preferably cobalt or vanadium phthalocyanine disulfonate at a concentration of from about 5 to 1000 wt. ppm. Carrier materials should be highly absorptive and capable of withstanding the alkaline environment. Activated charcoals have been found very suitable for this purpose, and either animal or vegetable charcoals may be used. The carrier material is to be suspended in a fixed bed which provides efficient circulation of the caustic solution. Preferably the metal phthalocyanine compound comprises about 0.1 to 2.0 wt. % of the final composite.

The oxidation conditions utilized include a pressure of from atmospheric to about 6895 kPag (1000 psig). This pressure is normally less than 500 kpag (72.5 psig). The temperature may range from ambient to about 95 degrees Celsius (203 degrees Fahrenheit) when operating near atmospheric pressure and to about 205 degrees Celsius (401 degrees Fahrenheit) when operating at superatmospheric pressures. In general, it is preferred that a temperature within the range of about 38 to about 80 degrees Celsius is utilized.

To separate the mercaptans from the base, the pressure in the phase separation zone may range from atmospheric to about 2068 kPag (300 psig) or more, but a pressure in the range of from about 65 to 300 kPag is preferred. The temperature in this zone is confined within the range of from about 10 to about 120 degrees Celsius (50 to 248 degrees Fahrenheit), and preferably from about 26 to 54 degrees Celsius. The phase separation zone is sized to allow the denser caustic mixture to separate by gravity from the disulfide compounds. This may be aided by a coalescing means located in the zone.

The above describes one possible method for regenerating used extractant. Other methods known to the skilled artisan may also be employed.

The following examples are meant to be illustrative and not limiting.

EXAMPLES

Example 1

A model feed composed of 2000 wppm sulfur as 1-heptanethiol in 67 wt % m-xylene and 33 wt % 1-octene was subjected to extraction by various basic agents. Treatments were done by merely shaking either 1 part or 3 parts of the base with 1 part of the heptanethiol solution. The organic layer was then sampled and tested using capillary and simultaneous GC and SCD detection. The remaining heptanethiol in the organic fraction is shown in Table 1. 1 N NaOH, representative of standard Merox extraction, results in less than 5% extraction regardless of treat rate. The addition of methanol or ethanol at 50 volume % to the caustic solution results in significantly higher extraction of the mercaptan. Ethanol is clearly superior to methanol at an equal treat rate. Increasing the base to 20 wt % or 6.2 N results in greater than 95% extraction of the mercaptan.

TABLE 1

| Extractant | 1:1 Caustic:feed volume wppm S as 1-heptanethiol remaining | 3:1 Caustic: feed volume wppm S as 1-heptanethiol remaining |
|---|---|---|
| 1N NaOH | 1972 | 1921 |
| 50% MeOH (1N NaOH) | 1365 | 755 |
| 50% EtOH (1 N NaOH) | 438 | 215 |
| 50% EtOH (6.2 N NaOH) | 84 | — |

Example 2

The effect of alcohol content on the level of heptanethiol left in the organic layer after a 1:1 extraction was tested. The effect of alcohol concentration is not linear.

The results of varying methanol and ethanol volume % in 1N NaOH are shown in Table 2. The starting petroleum product contained approximately 2000 wppm heptanethiol.

TABLE 2

| Alcohol | Vol % in caustic | Remaining heptanethiol |
|---|---|---|
| MeOH | 0 | 2000 |
| MeOH | 30 | 1800 |
| MeOH | 50 | 750 |
| EtOH | 0 | 2000 |
| EtOH | 30 | 1600 |
| EtOH | 50 | 500 |

Example 3

A hydroprocessed intermediate catalytic cracked naphtha with 52 wppm sulfur content and 47 wppm sulfur as mercaptan sulfur was subjected to extraction using either aqueous 20 wt % NaOH, representative of standard Merox extraction, or to ethanol/caustic extraction representative of this invention. The treat rate employed was 2:1 caustic:feed. Sulfur levels in the extracted organic layer are shown in Table 3. Caustic extraction results in only about 20 wt % extraction, whereas ethanol enhanced extraction results in greater than 80% extraction.

TABLE 3

| Extractant | wppm total sulfur | wppm mercaptan sulfur |
|---|---|---|
| 20% NaOH | 43 | 38 |
| 20% NaOH in 50% ethanol | 13 | 8 |

Example 4

The hydroprocessed intermediate catalytic cracked naphtha of Example 3 was subjected to staged extraction with 20% NaOH and with 20% NaOH in ethanol/water. Equal volumes of hydrocarbon and caustic solutions were shaken for two minutes. The caustic and hydrocarbon layers were allowed to separate, the caustic layer was replaced with fresh caustic solutions, and the mixture shaken for a 2nd two minute period. The layers were allowed to separate, the caustic solutions were replaced with fresh caustic solutions, and a final two minute shaking followed. The NaOH control removed 7% of the feed sulfur while the caustic solution/alcohol extracted >80% of the sulfur.

Example 5

The procedure of Example 4 was followed using an intermediate catalytic cracked naphtha containing 455 ppm sulfur, of which ~100 ppm was mercaptan sulfur. Staged extraction with 20% NaOH removed only 5% of the sulfur. Staged extraction with, 20% NaOH in ethanol/water removed 32% of the total sulfur and essentially all of the mercaptan sulfur.

What is claimed is:

1. A method for decreasing the amount of reversion mercaptans in a petroleum stream comprising:

(a) extracting said petroleum stream containing reversion mercaptans with an extractant comprising ethanol and an aqueous base to produce a product having a decreased concentration of reversion mercaptans and a used extractant comprising said extracted reversion mercaptans, ethanol and base; and (b) recovering said product having a decreased amount of reversion mercaptans.

2. The method of claim 1 wherein said petroleum stream is a hydroprocessed stream.

3. The method of claim 1 wherein said base is present in said extractant in an amount of about 1 to about 50 wt % based on the weight of the base and ethanol.

4. The method of claim 1 wherein said ethanol is present in amount at least about 10 volume % based on the volume of the ethanol and aqueous base.

5. The method of claim 2 wherein said hydroprocessed petroleum stream is thermally hydroprocessed or catalytically hydroprocessed.

6. The method of claim 1 wherein said petroleum feedstream is a naphtha feedstream.

7. The method of claim 1 wherein said used extractant is recycled to said step (a).

8. The method of claim 7 wherein said used extractant is first regenerated to remove reversion mercaptans.

* * * * *